US007136037B2

(12) United States Patent
Ham

(10) Patent No.: US 7,136,037 B2
(45) Date of Patent: Nov. 14, 2006

(54) METHOD AND APPARATUS FOR DRIVING LIQUID CRYSTAL DISPLAY

(75) Inventor: Yong Sung Ham, Kyounggi-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 230 days.

(21) Appl. No.: 09/993,522

(22) Filed: Nov. 27, 2001

(65) Prior Publication Data

US 2003/0095088 A1 May 22, 2003

(30) Foreign Application Priority Data

Sep. 17, 2001 (KR) ..... 2001-57119

(51) Int. Cl.
*G09G 3/36* (2006.01)

(52) U.S. Cl. ..... 345/89; 345/100; 345/213

(58) Field of Classification Search ..... 345/87–89, 345/98–100, 211–213, 690–691, 692, 693, 345/698

See application file for complete search history.

(56) References Cited

U.S. PATENT DOCUMENTS

| | | | | |
|---|---|---|---|---|
| 5,495,265 | A | 2/1996 | Hartman et al. | 345/87 |
| 5,815,135 | A * | 9/1998 | Yui et al. | 345/97 |
| 5,986,636 | A * | 11/1999 | Wu | 345/691 |
| 6,046,737 | A * | 4/2000 | Nakamura | 345/213 |
| 6,078,317 | A * | 6/2000 | Sawada | 345/204 |
| 6,348,931 | B1 * | 2/2002 | Suga et al. | 345/699 |
| 2002/0015016 | A1 * | 2/2002 | Kudo et al. | 345/87 |
| 2002/0030652 | A1 * | 3/2002 | Shibata et al. | 345/87 |
| 2003/0048247 | A1 * | 3/2003 | Ham | 348/87 |

FOREIGN PATENT DOCUMENTS

WO WO 99/05567 2/1999

* cited by examiner

*Primary Examiner*—Xiao Wu
(74) *Attorney, Agent, or Firm*—McKenna Long & Aldridge LLP

(57) ABSTRACT

The present invention discloses a method and apparatus for driving a liquid crystal display device that improves a picture quality. More specifically, in the method and apparatus, reference modulated data selected in accordance with a detected driving frequency are adjusted to modulate source data.

21 Claims, 5 Drawing Sheets

METHOD AND APPARATUS FOR DRIVING LIQUID CRYSTAL DISPLAY

This application claims the benefit of Korean Application No.P2001-57119 filed on Sep. 17, 2001, which is hereby incorporated by reference.

BACKGROUND OF THE INVENTION

1. Field of the Invention

The present invention relates to a liquid crystal display, and more particularly, to a method and apparatus for driving a liquid crystal display. Although the present invention is suitable for a wide scope of applications, it is particularly suitable for improving a picture quality in the liquid crystal display which is operated under different driving frequencies.

2. Discussion of the Related Art

Generally, a liquid crystal display (LCD) controls a light transmittance of each liquid crystal cell in accordance with a video signal, thereby displaying a picture. An active matrix LCD including a switching device for each liquid crystal cell is suitable for displaying a moving picture. The active matrix LCD uses a thin film transistor (TFT) as a switching device.

The LCD has a disadvantage in that it has a slow response time due to inherent characteristics of a liquid crystal, such as a viscosity and an elasticity, etc. Such characteristics can be explained by using the following equations (1) and (2):

$$\tau_r \propto \gamma d^2/\Delta\epsilon|V_a^2-V_F^2| \quad (1)$$

where $\tau_r$ represents a rising time when a voltage is applied to a liquid crystal, $V_a$ is an applied voltage, $V_F$ represents a Freederick transition voltage at which liquid crystal molecules begin to perform an inclined motion, d is a cell gap of the liquid crystal cells, and $\gamma$ represents a rotational viscosity of the liquid crystal molecules.

$$\tau_f \propto \gamma d^2/K \quad (2)$$

where $\tau_f$ represents a falling time at which a liquid crystal is returned into the initial position by an elastic restoring force after a voltage applied to the liquid crystal was turned off, and K is an inherent elastic constant of a liquid crystal.

A twisted nematic (TN) mode liquid crystal has a different response time due to physical characteristics of the liquid crystal and a cell gap, etc. Typically, the TN mode liquid crystal has a rising time of 20 to 80 ms and a falling time of 20 to 30 ms. Since such a liquid crystal has a response time longer than one frame interval (i.e., 16.67 ms in the case of NTSC system) of a moving picture, a voltage charged in the liquid crystal cell is progressed into the next frame prior to arriving at a target voltage. Thus, due to a motion-blurring phenomenon, a moving picture is blurred out on the screen.

Referring to FIG. 1, the conventional LCD cannot express desired color and brightness. Upon implementation of a moving picture, a display brightness BL fails to arrive at a target brightness corresponding to a change of the video data VD from one level to another level due to its slow response time. Accordingly, a motion-blurring phenomenon appears from the moving picture and a display quality is deteriorated in the LCD due to a reduction in a contrast ratio.

In order to overcome such a slow response time of the LCD, U.S. Pat. No. 5,495,265 and PCT International Publication No. WO99/05567 have suggested to modulate data in accordance with a difference in the data by using a look-up table (hereinafter referred to as high-speed driving scheme). This high-speed driving scheme allows data to be modulated by a principle as shown in FIG. 2.

Referring to FIG. 2, a conventional high-speed driving scheme modulates input data VD and applies the modulated data MVD to the liquid crystal cell, thereby obtaining a desired brightness MBL. In the high-speed driving scheme, $|V_a^2-V_F^2|$ is increased from the above equation (1) on the basis of a difference of the data so that a desired brightness can be obtained in response to a brightness value of the input data within one frame interval, thereby rapidly reducing a response time of the liquid crystal. Accordingly, the LCD employing such a high-speed driving scheme compensates for a slow response time of the liquid crystal by modulating a data value in order to alleviate a motion-blurring phenomenon in a moving picture, thereby displaying a picture at desired color and brightness.

In other words, the high-speed driving scheme compares most significant bits MSB of the previous frame Fn−1 with those of the current frame Fn. If there is a change in the most significant bits, the corresponding modulated data Mdata are selected from the look-up table to modulate the data as shown in FIG. 3. The high-speed driving scheme modulates only several most significant bits to reduce a memory size upon implementation of hardware equipment. A high-speed driving apparatus implemented in this manner is as shown in FIG. 4.

Referring to FIG. 4, a conventional high-speed driving apparatus includes a frame memory 43 connected to a most significant bit bus line 42 and a look-up table 44 commonly connected to the most significant bit bus line 32 and an output terminal of the frame memory 43.

The frame memory 43 stores most significant bit data MSB during one frame interval and supplies the stored data to the look-up table 44. Herein, the most significant bit data MSB may be the most significant 4 bits of the 8-bit source data RGB.

The look-up table 44 compares most significant bits MSB of a current frame Fn inputted from the most significant bit line 42 with those of the previous frame Fn−1 inputted from the frame memory 43 as shown in Table 1 or Table 2, and selects the corresponding modulated data Mdata. The modulated data Mdata are added least significant bits LSB from a least significant bit bus line 41.

TABLE 1

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 0 | 1 | 3 | 4 | 6 | 7 | 9 | 10 | 11 | 12 | 14 | 15 | 15 | 15 | 15 | 15 |
| 1 | 0 | 1 | 2 | 4 | 5 | 7 | 9 | 10 | 11 | 12 | 13 | 14 | 15 | 15 | 15 | 15 |
| 2 | 0 | 1 | 2 | 3 | 5 | 7 | 8 | 9 | 10 | 12 | 13 | 14 | 15 | 15 | 15 | 15 |
| 3 | 0 | 1 | 2 | 3 | 5 | 6 | 8 | 9 | 10 | 11 | 12 | 14 | 14 | 15 | 15 | 15 |
| 4 | 0 | 0 | 1 | 2 | 4 | 6 | 7 | 9 | 10 | 11 | 12 | 13 | 14 | 15 | 15 | 15 |
| 5 | 0 | 0 | 0 | 2 | 3 | 5 | 7 | 8 | 9 | 11 | 12 | 13 | 14 | 15 | 15 | 15 |
| 6 | 0 | 0 | 0 | 1 | 3 | 4 | 6 | 8 | 9 | 10 | 11 | 13 | 14 | 15 | 15 | 15 |

TABLE 1-continued

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 7 | 0 | 0 | 0 | 1 | 2 | 4 | 5 | 7 | 8 | 10 | 11 | 12 | 14 | 14 | 15 | 15 |
| 8 | 0 | 0 | 0 | 1 | 2 | 3 | 5 | 6 | 8 | 9 | 11 | 12 | 13 | 14 | 15 | 15 |
| 9 | 0 | 0 | 0 | 1 | 2 | 3 | 4 | 6 | 7 | 9 | 10 | 12 | 13 | 14 | 15 | 15 |
| 10 | 0 | 0 | 0 | 0 | 1 | 2 | 4 | 5 | 7 | 8 | 10 | 11 | 13 | 14 | 15 | 15 |
| 11 | 0 | 0 | 0 | 0 | 0 | 2 | 3 | 5 | 6 | 7 | 9 | 11 | 12 | 14 | 15 | 15 |
| 12 | 0 | 0 | 0 | 0 | 0 | 1 | 3 | 4 | 5 | 7 | 8 | 10 | 12 | 13 | 15 | 15 |
| 13 | 0 | 0 | 0 | 0 | 0 | 1 | 2 | 3 | 4 | 6 | 8 | 10 | 11 | 13 | 14 | 15 |
| 14 | 0 | 0 | 0 | 0 | 0 | 0 | 1 | 2 | 3 | 5 | 7 | 9 | 11 | 13 | 14 | 15 |
| 15 | 0 | 0 | 0 | 0 | 0 | 0 | 0 | 1 | 2 | 4 | 6 | 9 | 11 | 13 | 14 | 15 |

TABLE 2

| | 0 | 16 | 32 | 48 | 64 | 80 | 96 | 112 | 128 | 144 | 160 | 176 | 192 | 208 | 224 | 240 |
|---|---|---|---|---|---|---|---|---|---|---|---|---|---|---|---|---|
| 0 | 0 | 32 | 48 | 64 | 80 | 96 | 112 | 144 | 160 | 192 | 208 | 224 | 240 | 240 | 240 | 240 |
| 16 | 0 | 16 | 48 | 64 | 80 | 96 | 112 | 128 | 160 | 192 | 208 | 224 | 240 | 240 | 240 | 240 |
| 32 | 0 | 0 | 32 | 64 | 80 | 96 | 112 | 128 | 160 | 192 | 208 | 224 | 240 | 240 | 240 | 240 |
| 48 | 0 | 0 | 16 | 48 | 80 | 96 | 112 | 128 | 160 | 176 | 208 | 224 | 240 | 240 | 240 | 240 |
| 64 | 0 | 0 | 16 | 48 | 64 | 96 | 112 | 128 | 144 | 176 | 192 | 208 | 224 | 240 | 240 | 240 |
| 80 | 0 | 0 | 16 | 32 | 48 | 80 | 112 | 128 | 144 | 176 | 192 | 208 | 224 | 240 | 240 | 240 |
| 96 | 0 | 0 | 16 | 32 | 48 | 64 | 96 | 128 | 144 | 160 | 192 | 208 | 224 | 240 | 240 | 240 |
| 112 | 0 | 0 | 16 | 32 | 48 | 64 | 80 | 112 | 144 | 160 | 176 | 208 | 224 | 240 | 240 | 240 |
| 128 | 0 | 0 | 16 | 32 | 48 | 64 | 80 | 96 | 128 | 160 | 176 | 192 | 224 | 240 | 240 | 240 |
| 144 | 0 | 0 | 16 | 32 | 48 | 64 | 80 | 96 | 112 | 144 | 176 | 192 | 208 | 224 | 240 | 240 |
| 160 | 0 | 0 | 16 | 32 | 48 | 64 | 80 | 96 | 112 | 128 | 160 | 192 | 208 | 224 | 240 | 240 |
| 176 | 0 | 0 | 16 | 32 | 48 | 64 | 80 | 96 | 112 | 128 | 144 | 176 | 208 | 224 | 240 | 240 |
| 192 | 0 | 0 | 16 | 32 | 48 | 64 | 80 | 96 | 112 | 128 | 144 | 160 | 192 | 224 | 240 | 240 |
| 208 | 0 | 0 | 16 | 32 | 48 | 48 | 64 | 80 | 96 | 112 | 128 | 160 | 176 | 208 | 240 | 240 |
| 224 | 0 | 0 | 16 | 32 | 48 | 48 | 64 | 80 | 96 | 112 | 128 | 144 | 176 | 192 | 224 | 240 |
| 240 | 0 | 0 | 0 | 16 | 32 | 48 | 48 | 64 | 80 | 96 | 112 | 128 | 144 | 176 | 208 | 240 |

In the above tables, a left column is for a data voltage VDn−1 of the previous frame Fn−1 while an uppermost row is for a data voltage VDn of the current frame Fn. Table 1 is a look-up table information in which the most significant bits (i.e., $2^0$, $2^1$, $2^2$ and $2^3$) are expressed by the decimal number format. Table 2 is a look-up table information in which weighting values (i.e., $2^4$, $2^5$, $2^6$ and $2^7$) of the most significant 4 bits are applied to 8-bit data.

However, the conventional high-speed driving scheme still has a problem. Since it has been studied on the assumption that a driving frequency of the source data is fixed like a television, it was difficult to apply the scheme to a frequency-variable display device receiving different driving frequencies like a computer monitor. More specifically, in the conventional high-speed driving scheme, a voltage level of the modulated data Mdata is fixed to a specific frequency (e.g., 60 Hz) and a response time (i.e., 16.7 ms) of the liquid crystal fixed in accordance with the specific frequency. On the other hand, a computer monitor is manufactured so that its driving frequency can be changed in the range of 50 to 80 Hz. Therefore, in order to apply the conventional high-speed driving scheme to such a computer monitor, the modulated data Mdata established in the conventional high-speed driving scheme should be modified based on a driving frequency. This is because a voltage charged in a liquid crystal should be modified based on a driving frequency to adjust a response time of the liquid crystal. As a result, when the modulated data Mdata established based on a fixed driving frequency are applied to a monitor displaying a picture at a driving frequency different from the specific frequency, a picture is more deteriorated.

SUMMARY OF THE INVENTION

Accordingly, the present invention is directed to a method and apparatus for driving a liquid crystal display that substantially obviates one or more of problems due to limitations and disadvantages of the related art.

Another object of the present invention is to provide a method and apparatus for driving a liquid crystal display that improves a picture quality.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method of driving a liquid crystal display includes setting reference modulated data, detecting a driving frequency of source data for a current frame, and adjusting the reference modulated data in accordance with the detected driving frequency to modulate the source data.

In the method, the reference modulated data are set based on a desired reference frequency.

The method further includes dividing the source data into most significant bits and least significant bits, and delaying the most significant bits.

The delayed most significant bits are compared with non-delayed most significant bits to select the reference modulated data from a look-up table based on the compared result.

If the source data of a current frame becomes larger than that of the previous frame, reference modulated data VMdata adjusted in accordance with the driving frequency is determined by one of the following equations:

$$VMdata=LRef\times(Ft/Fref)$$

$$VMdata=LRef^{(Ft/Fref)}$$

where LRef represents the reference modulated data, Fref is the reference frequency, and Ft represents the detected driving frequency.

Otherwise, if the source data of a current frame becomes smaller than that of the previous frame, reference modulated data VMdata adjusted in accordance with the driving frequency is determined by one of the following equations:

$$VMdata=LRef\times(Fref/Ft)$$

$$VMdata=LRef^{(Fref/Ft)}$$

where LRef represents the reference modulated data, Fref is the reference frequency, and Ft represents the detected driving frequency.

On the other hand, if the source data of a current frame is equal to that of the previous frame, the reference modulated data bypass into an output stage.

In another aspect of the present invention, a method of driving a liquid crystal display includes setting reference modulated data, dividing a frequency band for each constant frequency band, setting a different weighting value for each frequency band, detecting a driving frequency of source data, determining the frequency band including the detected driving frequency, and assigning a weighting value of the frequency band including the driving frequency to the reference modulated data to adjust the reference modulated data, thereby modulating the source data.

In the method, the reference modulated data are set based on a desired reference frequency.

In another aspect of the present invention, a driving apparatus for a liquid crystal display includes a mode detector for detecting a driving frequency of current source data, and a modulator selecting reference modulated data from previously registered data and adjusting the selected reference modulated data in accordance with the detected driving frequency.

The driving apparatus further includes a frame memory delaying most significant bits of the current source data for one frame period.

In the driving apparatus, the modulator compares the delayed most significant bits with current most significant bits to select the reference modulated data based on the compared result.

If the source data of a current frame become larger than that of the previous frame, the modulator adjusts reference modulated data VMdata using one of the following equations:

$$VMdata=LRef\times(Ft/Fref)$$

$$VMdata=LRef^{(Ft/Fref)}$$

where LRef represents the reference modulated data, Fref is the reference frequency, and Ft represents the detected driving frequency.

Otherwise, if the source data of a current frame become smaller than that of the previous frame, the modulator adjusts reference modulated data VMdata using one of the following equations:

$$VMdata=LRef\times(Fref/Ft)$$

$$VMdata=LRef^{(Fref/Ft)}$$

where LRef represents the reference modulated data, Fref is the reference frequency, and Ft represents the detected driving frequency.

On the other hand, if the source data of a current frame are equal to that of the previous frame, the reference modulated data bypass into an output stage.

The driving apparatus further includes a data driver applying data outputted from the modulator to a liquid crystal display panel, a gate driver applying a scanning signal to the liquid crystal display panel, and a timing controller applying the source data to the modulator and the mode detector and controlling the data driver and the gate driver.

In a further aspect of the present invention, a driving apparatus for a liquid crystal display includes a mode detector detecting a driving frequency, a modulator selecting a reference modulated data and setting a different weighting value for each frequency band having a plurality of frequency ranges and assigning a weighting value of the frequency band including the detected frequency to the reference modulated data.

The driving apparatus further includes a data driver applying data modulated by the modulator to a liquid crystal display panel, a gate driver applying a scanning signal to the liquid crystal display panel, and a timing controller applying the source data to the modulator and the mode detector and controlling the data driver and the gate driver.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or like parts.

Figure 1:
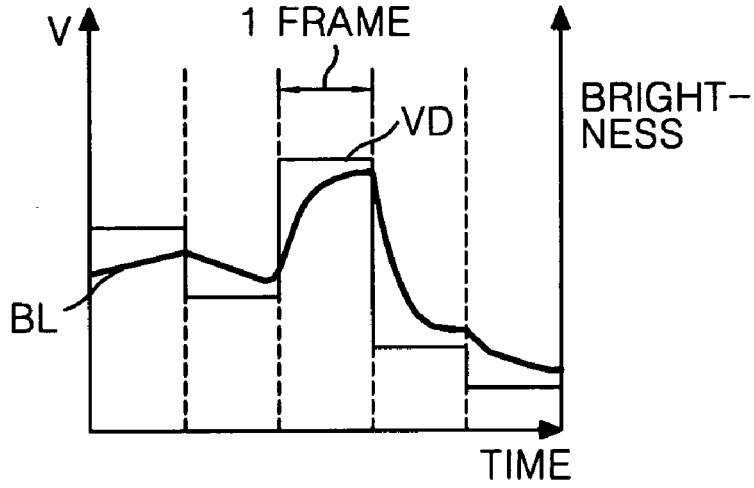
FIG. 1 CONVENTIONAL ART
FIG. 1 is a waveform diagram showing a brightness variation with respect to the applied voltage according to a conventional liquid crystal display.
Figure 2:
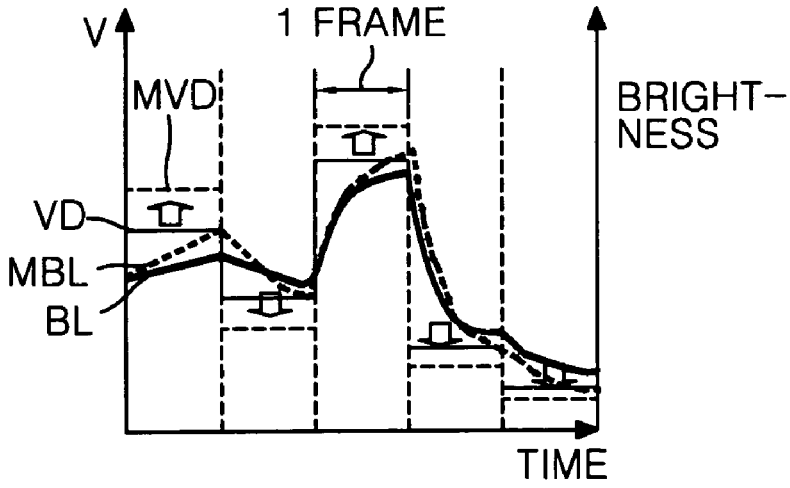
FIG. 2 CONVENTIONAL ART
FIG. 2 is a waveform diagram showing a brightness variation with respect to the applied voltage according to a conventional high-speed driving method using a data modulation.
Figure 3:
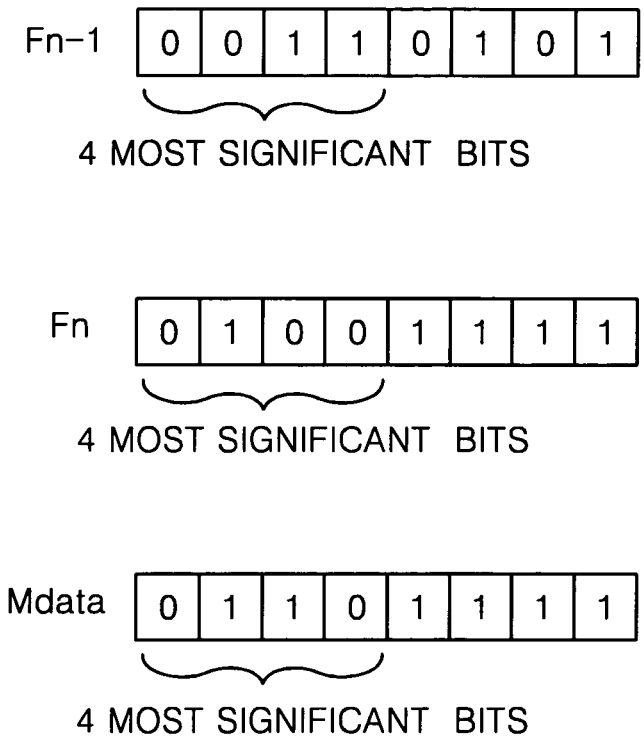
FIG.3 CONVENTIONAL ART
FIG. 3 illustrates a conventional high-speed driving method applied to 8-bit data.
Figure 4:
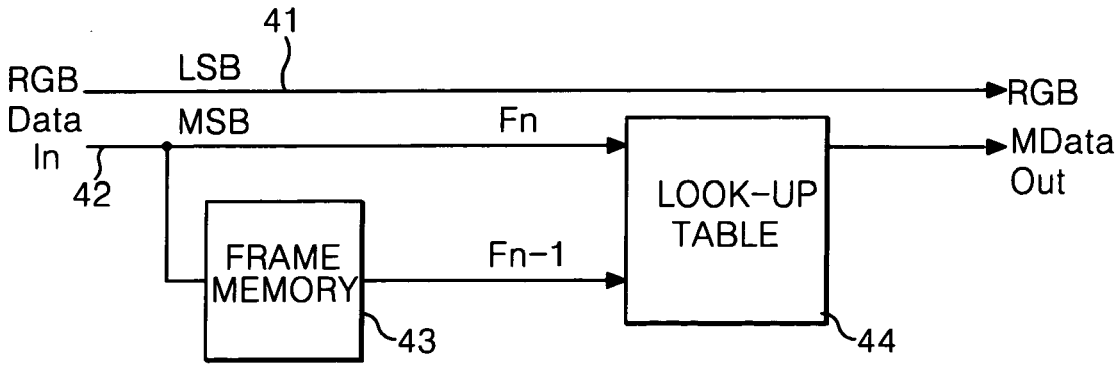
FIG.4 CONVENTIONAL ART
FIG. 4 is a block diagram showing a configuration of a conventional high-speed driving apparatus.
Figure 5:
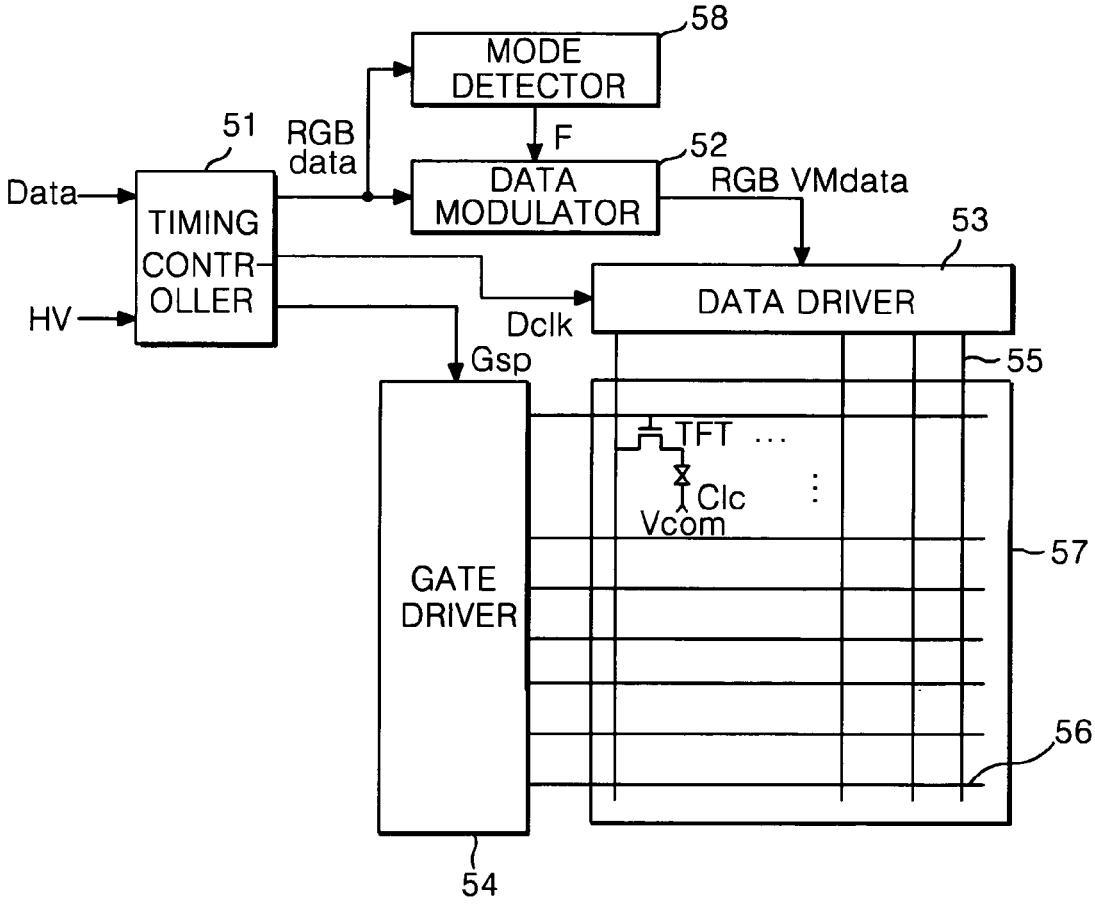
FIG. 5 is a block diagram showing a configuration of a driving apparatus for a liquid crystal display according to the present invention.

An apparatus for driving a liquid crystal display (LCD) according to the present invention is illustrated in FIG. 5.

The LCD driving apparatus includes a liquid crystal display panel 57 having a plurality of data lines 55 and a plurality of gate lines 56 crossing each other and having TFT's provided at the intersections therebetween to drive liquid crystal cells Clc. A data driver 53 supplies data to the data lines 55 of the liquid crystal display panel 57. A gate driver 54 applies a scanning pulse to the gate lines 56 of the liquid crystal display panel 57. A timing controller 51 receives digital video data and horizontal and vertical synchronizing signals H and V. A mode detector 58 detects a frequency of digital video data RGB. A data modulator 52 adjusts predetermined registered data varying with a frequency of the digital video data RGB.

More specifically, the liquid crystal display panel 57 has a liquid crystal formed between two glass substrates, and has the data lines 55 and the gate lines 56 provided on the lower glass substrate in such a manner to perpendicularly cross each other. The TFT provided at each intersection between the data lines 55 and the gate lines 56 responds to the scanning pulse to the data on the data line 55 to the liquid crystal cell Clc. To this end, a gate electrode of the TFT is connected to the gate line 56 while a source electrode thereof is connected to the data line 55. The drain electrode of the TFT is connected to a pixel electrode of the liquid crystal cell Clc.

The timing controller 51 rearranges the digital video data supplied from a digital video card (not shown). The RGB data rearranged by the timing controller 51 is supplied to the data modulator 52 and the mode detector 58. Further, the timing controller 51 generates timing signals, such as a dot clock Dclk, a gate start pulse GSP, a gate shift clock GSC (not shown), an output enable/disable signal, and a polarity control signal using the horizontal and vertical synchronizing signals H and V inputted thereto to control the data driver 53 and the gate driver 54. The dot clock Dclk and the polarity control signal are applied to the data driver 53 while the gate start pulse GSP and the gate shift clock GSC is applied to the gate driver 54.

The gate driver 54 includes a shift register sequentially generating a scanning pulse, that is, a gate high pulse in response to the gate start pulse GSP and the gate shift clock GSC applied from the timing controller 51, and a level shifter shifting a voltage of the scanning pulse into a level suitable for driving the liquid crystal cell Clc. The TFT is turned on in response to the scanning pulse. Upon turning on the TFT, the video data on the data line 55 are applied to the pixel electrode of the liquid crystal cell Clc.

The data driver 53 is supplied with frequency-variable data VMdata modulated by the data modulator 52 and receives the dot clock Dclk from the timing controller 51. The data driver 53 selects the variable modulated data VMdata in accordance with the dot clock Dclk and thereafter latches the data at each line. The data latched by the data driver 53 is converted into analog data to be simultaneously applied to the data lines 55 every scanning interval. Further, the data driver 53 may apply a gamma voltage corresponding to the modulated data to the data line 55.

The data modulator 52 modulates current input data RGB using registered data in the look-up table depending on a difference between the previous frame Fn−1 and the current frame Fn. Further, the data modulator 52 adjusts a voltage of the modulated data derived from the look-up table in response to a frequency-detecting signal F from the mode detector 58.

The mode detector 58 counts the digital video data RGB to detect a frequency of the digital video data RGB. Frequency information of the detected digital video data RGB is output to a control terminal of the data modulator 52 as the frequency-detecting signal F.

Figure 6:
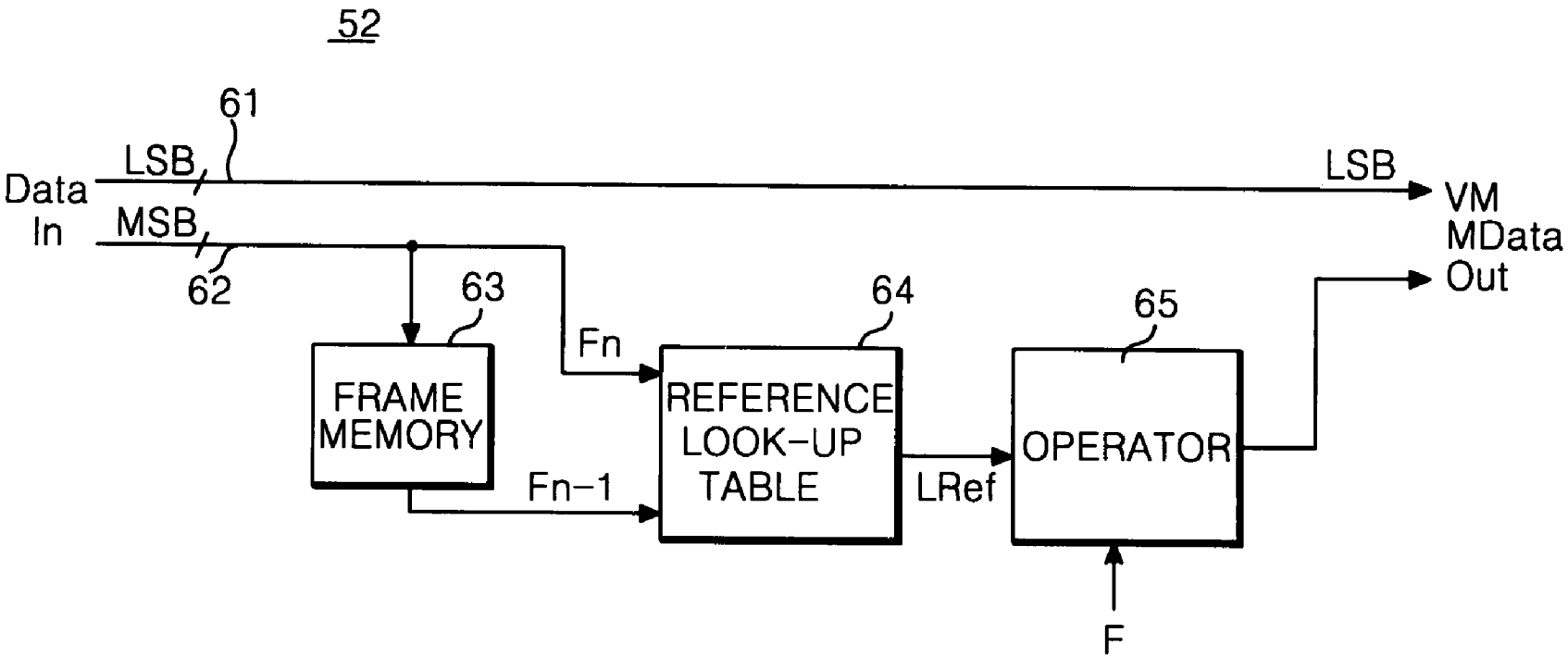
FIG. 6 is a detailed block diagram of the data modulator shown in FIG. 5.

FIG. 6 is a detailed block diagram of the data modulator 52 shown in FIG. 5.

Referring to FIG. 6, the data modulator 52 includes a frame memory 63 receiving most significant bits MSB, a reference look-up table 64 comparing the most significant bits MSB of the previous frame Fn−1 with those of the current frame Fn, and an operator 65 adjusting a reference modulated data LRef in response to the frequency-detecting signal F.

The frame memory 63 is connected to most significant bit bus line 62 of the timing controller 51 to store the most significant bits MSB inputted from the timing controller 51 during one frame interval. Further, the frame memory 63 applies the most significant bits MSB stored every frame to the reference look-up table 64.

The reference look-up table 64 compares the most significant bits MSB of the current frame Fn inputted from the most significant bit bus line 62 of the timing controller 51 with those of the previous frame Fn−1 inputted from the frame memory 63. Further, depending on the compared result, the reference look-up table 64 derives reference modulated data LRef satisfying one of the following equations:

$$VDn<VDn-1 \text{ - - - } >MVDn<MDn \quad \text{(i)}$$

$$VDn=VDn-1 \text{ - - - } >MVDn=VDn \quad \text{(ii)}$$

$$VDn>VDn-1 \text{ - - - } >MVDn>VDn \quad \text{(iii)}$$

In the above equations, VDn−1 represents a data voltage of the previous frame, VDn is a data voltage of the current frame, and MVDn represents a modulated data voltage.

The reference modulated data LRef may be given in the above-mentioned Table 1 or Table 2.

The operator 65 adjusts the reference modulated data LRef so that a response time of the liquid crystal may be varied with a driving frequency.

A response time of the liquid crystal required in accordance with a driving frequency may be given as the following table.

TABLE 3

| Driving Frequency (Hz) | 50 | 60 | 70 | 80 |
|---|---|---|---|---|
| Required Response Time (ms) | 20 | 16.7 | 14.3 | 12.5 |

As shown in Table 3, a response time of the liquid crystal required in accordance with a driving frequency is inversely proportional to the driving frequency.

The reference modulated data LRef should be adjusted in correspondence with a response time of the liquid crystal based on the relationship between the driving frequency and the response time of the liquid crystal. To this end, the operator 65 applies the reference modulated data LRef to the data driver 53 when the data RGB are not changed at the current frame Fn and the previous frame Fn−1, which satisfies the above equation (i). On the other hand, the operator 65 adjusts the reference modulated data LRef when the data RGB are changed, which is the case for the above equations (ii) and (iii), by using the following equations:

$$VM\text{data}=L\text{Ref}\times(Ft/F\text{ref}) \quad (3)$$

$$\text{VMdata}=\text{LRef}^{(Ft/Fref)} \quad (4)$$

$$VM\text{data}=L\text{Ref}\times(F\text{ref}/Ft) \quad (5)$$

$$\text{VMdata}=\text{LRef}^{(Fref/Ft)} \quad (6)$$

In the equations (3) to (6), Fref represents a reference frequency (e.g., 60 Hz), which is a frequency set to be suitable for registered data in the reference look-up table 64. Ft represents a frequency of the current input data RGB.

If source data of the current frame Fn become larger than that of the previous frame Fn−1 as given in the above equation (i), the operator 65 adjusts the reference modulated data LRef in accordance with a newly set frequency, that is, a detected driving frequency using the above equations (3) and (4). On the other hand, if the source data of the current frame Fn become smaller than those of the previous frame Fn−1 as given in the above equation (iii), the operator 65 adjusts the reference modulated data LRef in accordance with a newly set frequency, that is, a detected driving frequency using the above equations (5) and (6).

As shown in the above equations (3) to (6), the operator 65 inversely adjusts the modulated data based on how the data RGB are changed. For instance, if a driving frequency is increased, then a response time of the liquid crystal required in correspondence with the driving frequency should be reduced as indicated in Table 3. In this case, if the most significant bits MSB of the current frame Fn become larger than those of the previous frame Fn−1, the operator 65 modulates the reference modulated data LRef more. Otherwise, if the most significant bits MSB of the current frame Fn become smaller than those of the previous frame Fn−1, the operator 65 modulates the reference modulated data LRef less.

In the mean time, the operator 65 may modulate the reference modulated data LRef using an arithmetic algorithm as indicated in the above equations (3) to (6) in accordance with a driving frequency. However, a weighting value may have to be given to each frequency band as indicated in the following table:

TABLE 4

| Driving Frequency Band (Hz) | Required Response Time of Liquid Crystal (ms) | Weighting Value (W) |
|---|---|---|
| 50~55 | 18.2~20.0 | 1.05 |
| 56~65 | 15.4~18.2 | 1.00 |
| 66~75 | 13.3~15.2 | 0.95 |
| 76~80 | 12.5~13.2 | 0.90 |

The weighting value for each frequency band should be considered because a difference in a response time of the liquid crystal almost does not exist in the case of a small frequency variation.

As shown in Table 4, the reference modulated data LRef of the reference look-up table 64 are not adjusted at the driving frequency band of 56 Hz to 65 Hz, hereinafter referred to as a "reference frequency band", whereas the reference modulated data LRef are increased or decreased in accordance with a frequency at a frequency band lower or higher than the reference frequency.

For instance, in the case where the driving frequency becomes high, the operator 65 divides the reference modulated data LRef by the weighting value W to further heighten the variable modulated data VMdata than the reference modulated data LRef when the source data of the current frame Fn become larger than that of the previous frame Fn−1, which satisfies the above equation (i). Otherwise, the operator 65 multiplies the reference modulated data LRef by the weighting value W to further lower the variable modulated data VMdata than the reference modulated data LRef when the source data of the current frame Fn become smaller than that of the previous frame Fn−1, which satisfies the above equation (iii). If variable modulated data VMdata are adjusted at such a high driving frequency, a response time of the liquid crystal becomes fast.

On the other hand, in the case where a driving frequency becomes low, the operator 65 divides the reference modulated data LRef by the weighting value W to further lower the variable modulated data VMdata than the reference modulated data LRef when the source data of the current frame Fn become larger than that of the previous frame Fn−1, which satisfies the above equation (i). Otherwise, the operator 65 multiplies the reference modulated data LRef by the weighting value W to further heighten the variable modulated data VMdata than the reference modulated data LRef when the source data of the current frame Fn become smaller than that of the previous frame Fn−1, which satisfies the above equation (iii). If the variable modulated data VMdata are adjusted at such a low driving frequency, a response time of the liquid crystal becomes slow.

Figure 7:
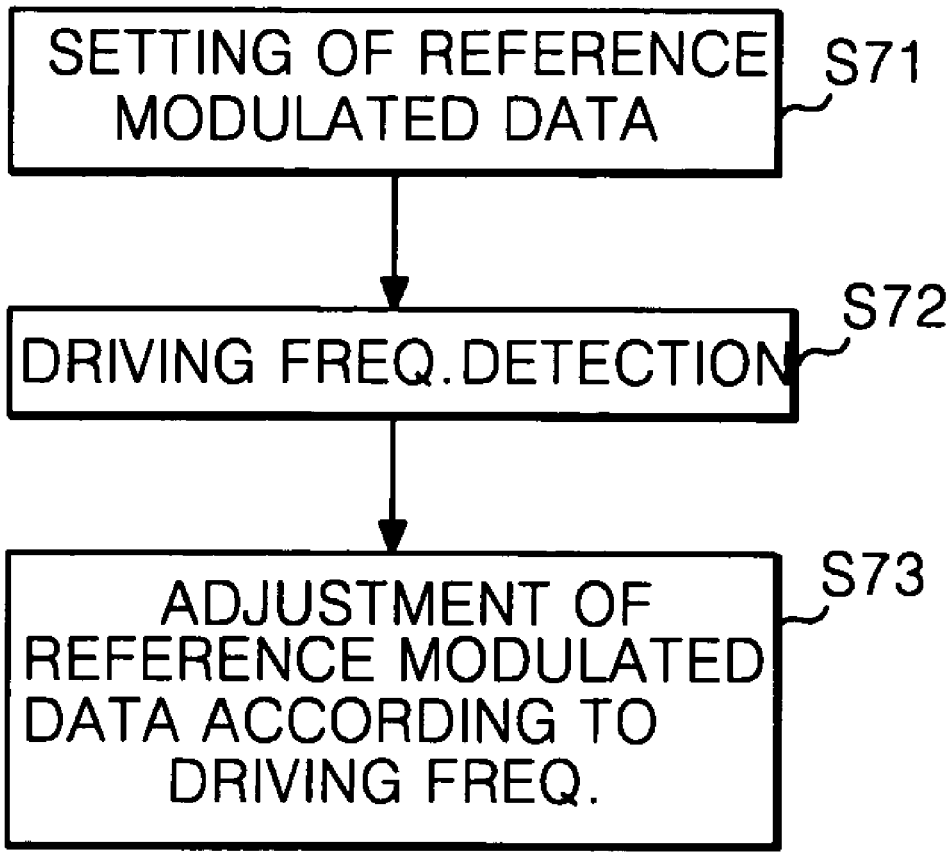
FIG. 7 is a flow chart representing a modulating procedure of the liquid crystal display according to the present invention.

In the LCD driving method and apparatus according to the present invention, the above-mentioned data modulating procedure can be summarized into a flow chart as shown in FIG. 7.

Referring to FIG. 7, modulated data set in correspondence with the reference frequency are registered in the reference look-up table 64 at step S71. Subsequently, if a driving frequency is detected by means of the mode detector 57 at step S72, then a value of the reference modulated data is adjusted by one of the above equations (3) to (6) or given with a weighting value W as indicated in Table 4 to satisfy a response time of the liquid crystal required in correspondence with the detected driving frequency at step S73.

Meanwhile, the above-mentioned case where the operator 65 multiplies or divides the reference modulated data LRef by a weighting value to assign the weighting value has the premise that the weighting value is set to be smaller than 1 at a frequency band in which a driving frequency of the current frame becomes higher than the reference frequency. Conversely, the weighting value is set to be larger than 1 at a frequency band in which a driving frequency of the current frame becomes lower than the reference frequency, as indicated in Table 4. Accordingly, in the case where a weighting value is set to a value different from Table 4, a weighting value assigning method using an addition or subtraction rather than using a multiplication or division may be applied.

The present LCD driving method and apparatus has described a scheme of driving only most significant bits, but may modulate full bits of the source data (i.e., 8 bits).

As described above, according to the present invention, a reference modulated data is set to adjust the reference modulated data in accordance with a driving frequency, thereby synchronizing a response time of the liquid crystal required for each driving frequency. As a result, an optimal high-speed driving is realized for a liquid crystal display device having a varying driving frequency, so that it improves a picture quality.

The data modulator and the operator may be implemented by other means, such as a program and a microprocessor for carrying out this program, besides the look-up table. Also, the present invention may be applicable to all other fields requiring a data modulation, such as a plasma display panel, an field emission display and an electro-luminescence display, etc.

It will be apparent to those skilled in the art that various modifications and variations can be made in the method and apparatus for driving the liquid crystal display of the present invention without departing from the spirit or scope of the inventions. Thus, it is intended that the present invention covers the modifications and variations of this invention provided they come within the scope of the appended claims and their equivalents.

What is claimed is:

1. A method of driving a liquid crystal display, comprising:

setting reference modulated data for each pixel in a current frame, wherein the reference modulated data is based upon the difference between a brightness value of the pixel in the current frame and a brightness value of the pixel for a previous frame;

detecting a driving frequency of video image data for the current frame; and adjusting the reference modulated data in accordance with the detected driving frequency to modulate the video image data.

2. The method according to claim 1, wherein the reference modulated data are set based on a desired reference frequency.

3. The method according to claim 1, further comprising:

dividing the video image data into most significant bits and least significant bits; and delaying the most significant bits for one frame period.

4. The method according to claim 3, wherein the delayed most significant bits are compared with current most significant bits to select the reference modulated data from a look-up table based on the compared result.

5. The method according to claim 1, wherein the reference modulated data (VMdata) are adjusted in accordance with the driving frequency by using one of the following equations if the video image data of the current frame become larger than that of a previous frame, $$VM\text{data}=L\text{Ref}\times(Ft/F\text{ref})$$

$$\text{VMdata}=LRef^{(Ft/Fref)}$$

where LRef represents the reference modulated data, Fref is the reference frequency, and Ft represents the detected driving frequency.

6. The method according to claim 1, wherein the reference modulated data (VMdata) are adjusted in accordance with the driving frequency by using one of the following equations if the video image data of the current frame become smaller than that of a previous frame, $$VM\text{data}=L\text{Ref}\times(Ft/F\text{ref})$$

$$\text{VMdata}=\text{LRef}^{(Ft/Fref)}$$

where LRef represents the reference modulated data, Fref is the reference frequency, and Ft represents the detected driving frequency.

7. The method according to claim 1, wherein the reference modulated data bypass into an output stage if the video image data of the current frame are equal to that of a previous frame.

8. A method of driving a liquid crystal display, comprising:

setting reference modulated data for each pixel in a current frame, wherein the reference modulated data is based upon the difference between a brightness value of the pixel in the current frame and a brightness value of the pixel for a previous frame;

dividing a frequency band for each constant frequency band;

setting a different weighting value for each frequency band;

detecting a driving frequency of video image data;

determining the frequency band including the detected driving frequency; and assigning a weighting value of the frequency band including the driving frequency to the reference modulated data to adjust the reference modulated data, thereby modulating the video image data.

9. The method according to claim 8, wherein the reference modulated data are based on a desired reference frequency.

10. A driving apparatus for a liquid crystal display, comprising:

a mode detector detecting a driving frequency of current video image data; and a modulator selecting reference modulated data for each pixel in a current frame, wherein the reference modulated data is based upon the difference between a brightness value of the pixel in the current frame and a brightness value of the pixel for a previous frame and adjusting the selected reference modulated data in accordance with the detected driving frequency.

11. The driving apparatus according to claim 10, wherein the modulator includes a frame memory delaying most significant bits of the current video image data for one frame period.

12. The driving apparatus according to claim 11, wherein the modulator compares the delayed most significant bits with current most significant bits to select the reference modulated data based on the compared result.

13. The driving apparatus according to claim 11, wherein the modulator adjusts the reference modulated data (VMdata) using one of the following equations if the current video image data become larger than the delayed video image data, $$VM\text{data}=L\text{Ref}\times(Ft/F\text{ref})$$

$$\text{VMdata}=\text{LRef}^{(Ft/Fref)}$$

where LRef represents the reference modulated data, Fref is the reference frequency, and Ft represents the detected driving frequency.

14. The driving apparatus according to claim 11, wherein the modulator adjusts the reference modulated data (VMdata) by using one of the following equations if the current video image data become smaller than the delayed video image data, $$VM\text{data}=L\text{Ref}\times(Ft/F\text{ref})$$

$$\text{VMdata}=\text{LRef}^{(Ft/Fref)}$$

where LRef represents the reference modulated data, Fref is the reference frequency, and Ft represents the detected driving frequency.

15. The driving apparatus according to claim 11, wherein the reference modulated data bypass into an output stage if the current video image data are equal to the delayed video image data.

16. The driving apparatus according to claim 10, further comprising:

a data driver applying data outputted from the modulator to a liquid crystal display panel;

a gate driver applying a scanning signal to the liquid crystal display panel; and a timing controller applying the current video image data to the modulator and the mode detector and controlling the data driver and the gate driver.

17. The driving apparatus according to claim 10, wherein the modulator comprises:

a frame memory storing most significant bits of a current frame and outputting the most significant bits of a previous frame;

a reference look-up table comparing the current most significant bits with the previous most significant bits and outputting reference modulated data; and an operator adjusting the reference modulated data, so that a response time of a liquid crystal is varied in accordance with a driving frequency.

18. A driving apparatus for a liquid crystal display, comprising:

a mode detector detecting a driving frequency of current video image data; and a modulator selecting reference modulated data for each pixel in a current frame, wherein the reference modulated data is based upon the difference between a brightness value of the pixel in the current frame and a brightness value of the pixel for a previous frame, setting a different weighting value for each frequency band having a plurality of frequency ranges, and assigning a weighting value of the frequency band including the detected frequency to the reference modulated data.

19. The driving apparatus according to claim 18, further comprising:

a data driver applying data modulated by the modulator to a liquid crystal display panel;

a gate driver applying a scanning signal to the liquid crystal display panel; and a timing controller applying the current video image data to the modulator and the mode detector and controlling the data driver and the gate driver.

20. A liquid crystal display comprising:

a liquid crystal display panel having a plurality of data lines and a plurality of gate lines thereon;

a mode detector detecting a driving frequency of current video image data;

a modulator selecting reference modulated data for each pixel in a current frame, wherein the reference modulated data is based upon the difference between a brightness value of the pixel in the current frame and a brightness value of the pixel for a previous frame and adjusting the selected reference modulated data in accordance with the detected driving frequency;

a data driver applying the data modulated by the modulator to the liquid crystal display panel;

a gate driver applying a scanning signal to the liquid crystal display panel; and a timing controller applying the current video image data to the modulator and the mode detector and controlling the data driver and the gate driver.

21. A liquid crystal display comprising:

a liquid crystal display panel having a plurality of data lines and a plurality of gate lines thereon;

a mode detector detecting a driving frequency of current video image data;

a modulator selecting reference modulated data for each pixel in a current frame, wherein the reference modulated data is based upon the difference between a brightness value of the pixel in the current frame and a brightness value of the pixel for a previous frame, setting a different weighting value for each frequency band having a plurality of frequency ranges and assigning a weighting value of the frequency band including the detected frequency of the reference modulated data;

a data driver applying the data modulated by the modulator to the liquid crystal display panel;

a gate driver applying a scanning signal to the liquid crystal display panel; and a timing controller applying the current video image data to the modulator and the mode detector and controlling the data driver and the gate driver.

* * * * *